United States Patent [19]

Burns

[11] 4,004,692

[45] * Jan. 25, 1977

[54] COT DISPENSER

[75] Inventor: James A. Burns, Elizabeth, N.J.

[73] Assignee: Becton, Dickinson and Company, East Rutherford, N.J.

[ * ] Notice: The portion of the term of this patent subsequent to Jan. 25, 1992, has been disclaimed.

[22] Filed: Feb. 23, 1973

[21] Appl. No.: 335,360

[52] U.S. Cl. ..... 206/486; 206/499; 206/526; 221/92; 229/29 F

[51] Int. Cl.[2] ..... B65D 83/00; B65D 85/62

[58] Field of Search ..... 206/486, 499, 3, 306, 206/212, 503, 498, 526; 229/29 F, 27, 45, 51 D; 221/92

[56] References Cited

UNITED STATES PATENTS

| | | | |
|---|---|---|---|
| 1,021,998 | 4/1912 | Myers | 229/27 |
| 1,081,981 | 12/1913 | Palmer | 229/45 |
| 1,353,629 | 9/1920 | Cibulka | 229/29 F |
| 2,090,882 | 8/1937 | Zimmerman | 229/27 |
| 2,142,567 | 1/1939 | Levy | 206/486 |
| 2,325,755 | 8/1943 | Eggebrecht | 229/27 |
| 2,325,756 | 8/1943 | Eggebrecht et al. | 229/27 |
| 3,254,533 | 6/1966 | Tongret | 73/362 AR |
| 3,424,298 | 1/1969 | Wallace et al. | 206/3 |
| 3,533,874 | 10/1970 | Elias | 206/3 |

*Primary Examiner*—William T. Dixson, Jr.
*Attorney, Agent, or Firm*—Kane, Dalsimer, Kane, Sullivan and Kurucz

[57] ABSTRACT

A folded cardboard carton has spaced perforations formed in a pair of opposing side walls. Each perforation is adapted to receive a stack of rubber cots, the stacks being formed by cots telescoped one inside the other. Tear away covers are mounted to said carton for covering and enclosing the stacks of cots suspended in the perforations. The covers are perforated to facilitate the opening of a portion of said cover at a time so as to serially expose the stacks of cots. A single cot is dispensed by inserting a medical probe into an exposed stack of cots and depressing the entire stack while locking the uppermost cot to the probe. The resiliency of the stacked cots facilitates removal of the uppermost cot without disturbing the remaining cots.

13 Claims, 6 Drawing Figures

COT DISPENSER

BACKGROUND OF THE INVENTION

1. Field of the Invention

The present invention relates to cot dispensing systems and more particularly to a cot dispenser in which the cots are telescopically stacked and suspended in a perforated cot support.

2. Description of the Prior Art

U.S. Pat. No. 3,673,868 issued on July 4, 1972, discloses an improved electronic-medical thermometer. The thermometer is designed to receive and retain a disposable latex cot or sheath over its sensing element during temperature measurements to prevent contamination from spreading between patients during subsequent temperature measurements.

The thermometer disclosed in the above-referenced patent is provded with cot retaining means in the form of resilient, outwardly biased portions spaced rearwardly of the sensing element for engaging the inner surface of a beaded rim of an associated cot when the cot is stretched over the sensing element. After use, the outwardly biased portions of the thermometer are squeezed inwardly thereby enabling the cot to be ejected by virtue of the natural resiliency of the cot.

Heretofore, cots were provided in various forms of packages. Some cots were supplied unwrapped in bulk containers to be individually placed on a temperature probe while others were provided in separate, sterilized wrappers. An improved form of cot dispenser was disclosed in U.S. patent application Ser. No. 184,129 filed on Sept. 27, 1971 which is presently pending and commonly assigned herewith. The improved dispensing package included a flat, two-ply sheet formed of relatively rigid cardboard material having a plurality of openings extending through the sheet with openings through the top ply being slightly larger than the corresponding openings through the bottom ply. The cots were disposed within these openings and were removed by inserting the previously described electronic-medical thermometer into the cot and stretching the cot with the thermometer while engaging the cot rim with the cot retaining means on the probe.

Prior to the development of the improved dispensing package, cots had to be individually stretched over the temperature probe. In doing so the cot was extensively handled and the possibility of contamination was greatly increased. Valuable time was also lost while one fumbled with the cot trying to stretch it over a temperature probe. The improved dispensing package clearly provided a more convenient system for dispensing cots and placing the cots over the temperature probe.

One disadvantage of the improved dispensing package was that all of the cots were simultaneously exposed to the atmosphere and therefore were subjected to contamination prior to use. This was especially true if all of the cots in the package were not used at one time. Thus, the prior art did not provide a convenient cot dispenser that exposed only one cot at a time.

In another commonly assigned copending application, Ser. No. 320,532 there was disclosed a cot dispenser system having an elongated tape with spaced perforations in which rubber cots were suspended. The tape was wound in a compact roll and inserted into a dispensing container which was either reusable or disposable. A tape support was positioned to support an unrolled portion of the tape so that a cot could be freely suspended from the unrolled portion for removal through an opening in the container by insertion of a medical probe. This dispensing system had many advantages over the prior art but a sufficiently rigid dispenser proved to be somewhat expensive and therefore less expensive alternatives were sought.

SUMMARY OF THE INVENTION

The present invention contemplates a system for packaging and dispensing latex cots of the type having an elongated tubular body portion with a closed bottom end and an open top end with an enlarged beaded rim formed about the open top end. The package comprises a folded cardboard carton having perforations formed in a pair of opposed side walls said perforations being adapted to receive stacks of cots formed by telescoping the cots one inside the other.

It is contemplated that five perforations will be formed in each of the opposed side walls and that a stack of five cots will be suspended in each of the perforations. Covers are provided for covering and enclosing the suspended stacks of cots, said covers being adapted to be fitted in place after the cots are automatically stacked and inserted into the perforations.

The covers are perforated along the edges so that they may be opened by peeling the cover back to serially expose the stacks of cots. The cover includes a closure tab that may be inserted into the carton so that the opened portion of the cover may be replaced to cover any unused cots in the exposed stack. Perforations are also provided on the cover to facilitate bending of the opened portion of the cover and to allow for tearing the opened portion from the cover should the user desire to permanently remove the opened portion.

The invention is uniquely characterized by the ease with which a single cot is removed.

A temperature probe of the type described in U.S. Pat. No. 3,673,868 is inserted into the uppermost cot in a stack. The entire stack of cots is depressed or stretched while the uppermost cot is engaged by the probe. The inherent resiliency of the remaining cots urges the probe and the engaged cot out of the stack without distrubing the cots remaining in the stack.

The result is unique and surprising since one would normally expect the stacked latex cots to cling together and that difficulty would be experienced when removing the cots.

The invention will subsequently be described in its preferred embodiment that has many advantages over the prior art. However, it must be remembered that the primary inventive concept lies in the idea of supporting a stack of telescoped cots for removal one at a time by a medical probe.

Thus, the present invention provides a unique and inexpensive cot dispensing system that facilitates easy removal of a cot with a temperature probe. The outside surfaces of the cots with which the patient comes in contact always remain within the box in a protected environment so as to remain in a sanitary condition. The only portion of the cot that is exposed to the atmosphere is the beaded rim and the inside of the cot which does not in normal use come in contact with the patient and therefore this need not be of concern.

The primary objective of the present invention is to provide an inexpensive cot dispenser.

Another objective of the present invention is to provide a cot dispenser that facilitates easy removal of the cots by use of a medical probe.

Another objective of the present invention is to provide a cot dispenser that maintains the unused cots in an unexposed and sanitary condition prior to use.

Another objective of the present invention is to provide a cot dispenser in which an exposed cot may be recovered for subsequent use.

The foregoing objectives and advantages of the invention will appear more fully hereinafter from a consideration of the detailed description which follows, taken together with the accompanying drawings, wherein one embodiment of the invention is illustrated by way of example. It is to be expressly understood, however, that the drawings are for illustrative purposes only and are not to be considered as defining the limits of the invention.

DESCRIPTION OF THE INVENTION

Figure 1:
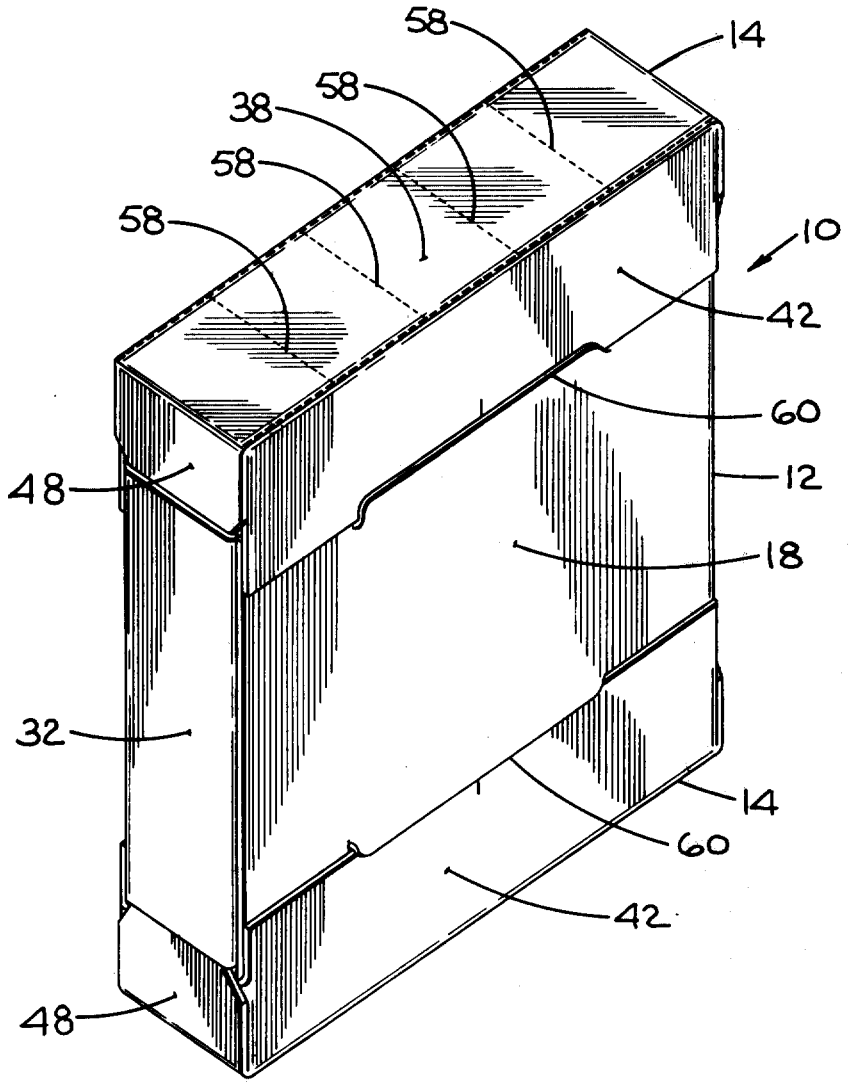
FIG. 1 is a perspective view of a cot dispenser constructed in accordance with the present invention.

Referring to FIG. 1 there is shown a perspective view of a cot dispenser 10 constructed in accordance with the teachings of the present invention. The dispenser comprises a container in the form of a folded cardboard carton 12 and a pair of end covers 14. In the preferred embodiment carton 12 is formed from a unitary carton blank shown in FIG. 2 and the covers 14 are formed by folding a carboard blank shown in FIG. 3.

Figure 2:
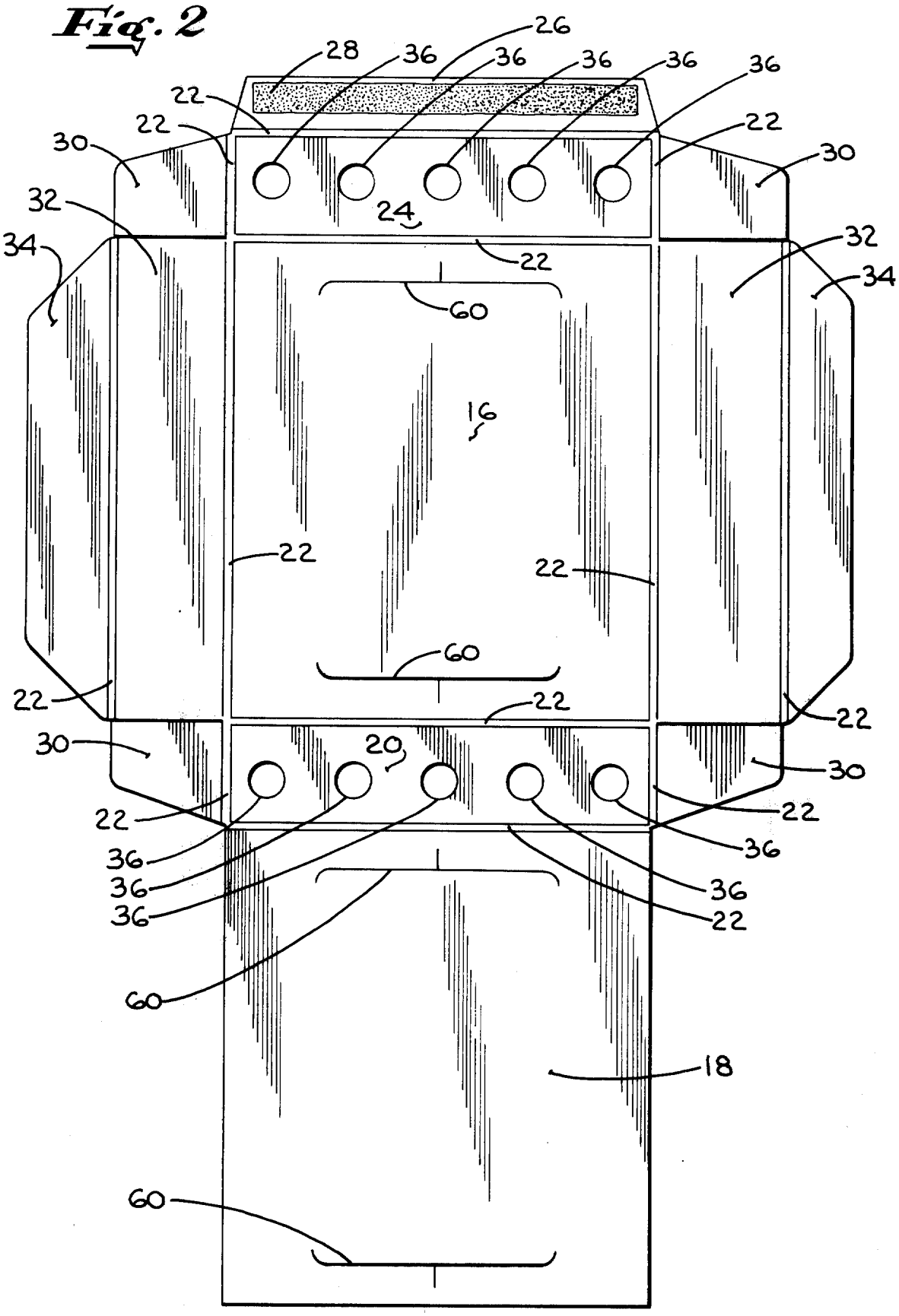
FIG. 2 is a plan view of a carton blank prior to erection.

Referring to FIG. 2, the carton blank comprises first and second side wall panels 16 and 18 separated by an end panel 20. The side wall panels are connected to the end panel 20 by a pair of score lines 22. Another end panel 24 is attached to the first side wall panel 16 by a score line 22 and a connecting panel 26 is attached to the end panel 24 by a score line 22. When carton 12 is erected, score lines 22 are folded at right angles so that side wall panels 16 and 18 are opposite each other and the end panels 20 and 24 are opposite each other with connecting panel 26 being overlapped by side wall panel 18. Connecting panel 26 is attached to side wall panel 18 by the use of adhesive 28 to form a generally rectangularly shaped body portion of the carton.

A pair of closure assemblies are provided on each side of side wall panel 16 for closing the erected carton. Each closure assembly comprises a pair of closure tabs 30 connected to the end panels 20 and 24 by score lines 22 and a closure panel 32 connected to side wall panel 16 by score line 22. Each of the closure panels 32 has attached thereto a closure flap 34 connected by score lines 22. The carton is closed by first folding tabs 30 at right angles to the end panels and closure panels 32 are then folded to overlap tabs 30 and closure flaps 34 are inserted into the erected carton adjacent the edges of the second side wall panel 18.

End panels 20 and 24 have a plurality of spaced perforations 36 formed therein, said perforations being preferably disposed in a straight line.

Figure 3:
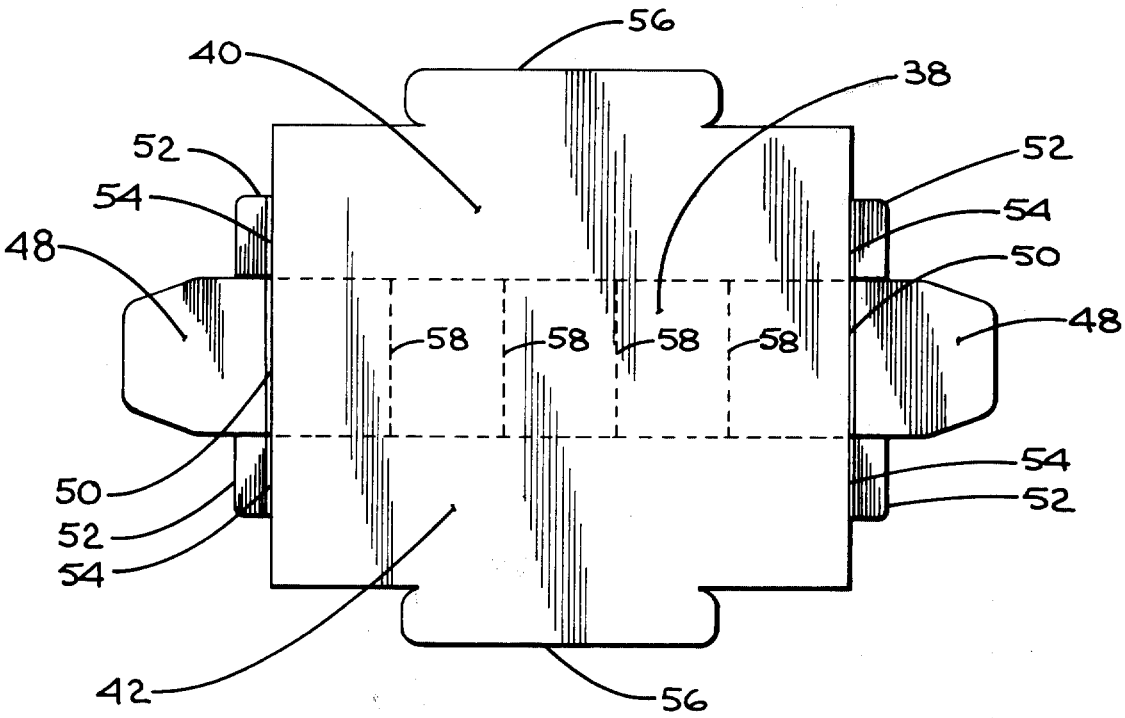
FIG. 3 is a plan view of a blank for forming a cover.

Referring to FIG. 3 there is shown a cardboard blank adapted to be folded to form a cover 14. The cover includes a top portion 38 and side portions 40 and 42 connected to top portion 38 by a pair of parallel perforated longitudinal lines 44 and 46. A pair of end flaps 48 are connected to the top portion 38 by a pair of score lines 50. Each of the side portions 40 and 42 have a pair of closure tabs 52 connected thereto by score lines 54. The outer edges of side panels 40 and 42 have insert tabs 56 formed as an extension thereof. Extending transverse to top portion 38 and perpendicular to perforated lines 44 and 46 are a plurality of perforated lines 58 connecting lines 44 and 46. Lines 58 divide top portion 38 into a plurality of separable portions corresponding in number to the number of perforations formed in each of the end panels 20 and 24.

Figure 4:
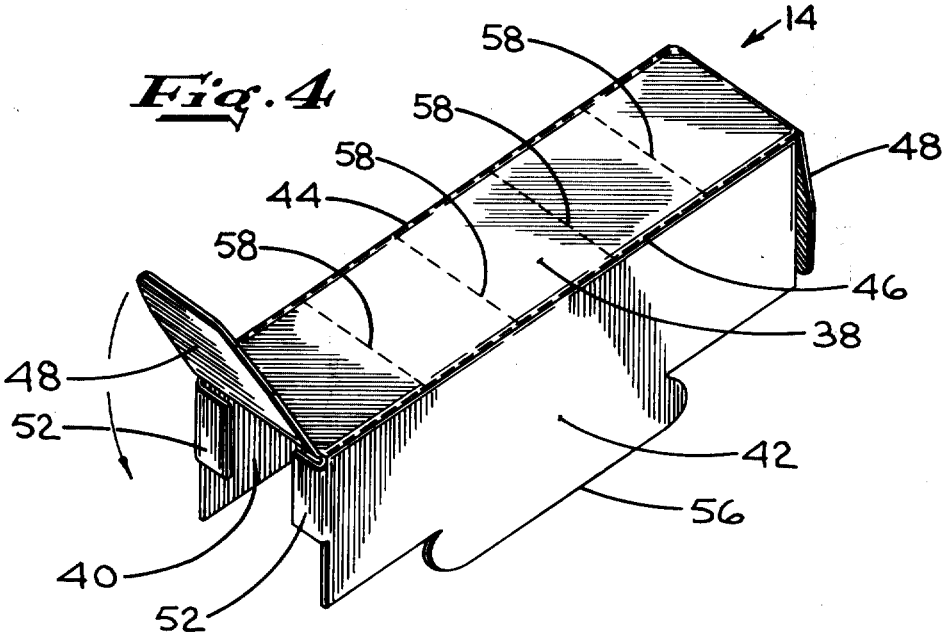
FIG. 4 is a perspective view of a cover formed by the blank shown in FIG. 3.

Referring to FIG. 4 there is shown the cover of FIG. 3 partially erected. Tabs 52 are folded inwardly at a right angle to side panels 40 and 42 and end flaps 48 are folded at right angles to top portion 38 so as to overlap tabs 52.

Referring again to FIG. 2 side wall panels 16 and 18 each have a pair of slots 60 formed therein, said slots having a length substantially equal to the length of insert tabs 56 of the cover 14.

Figure 5:
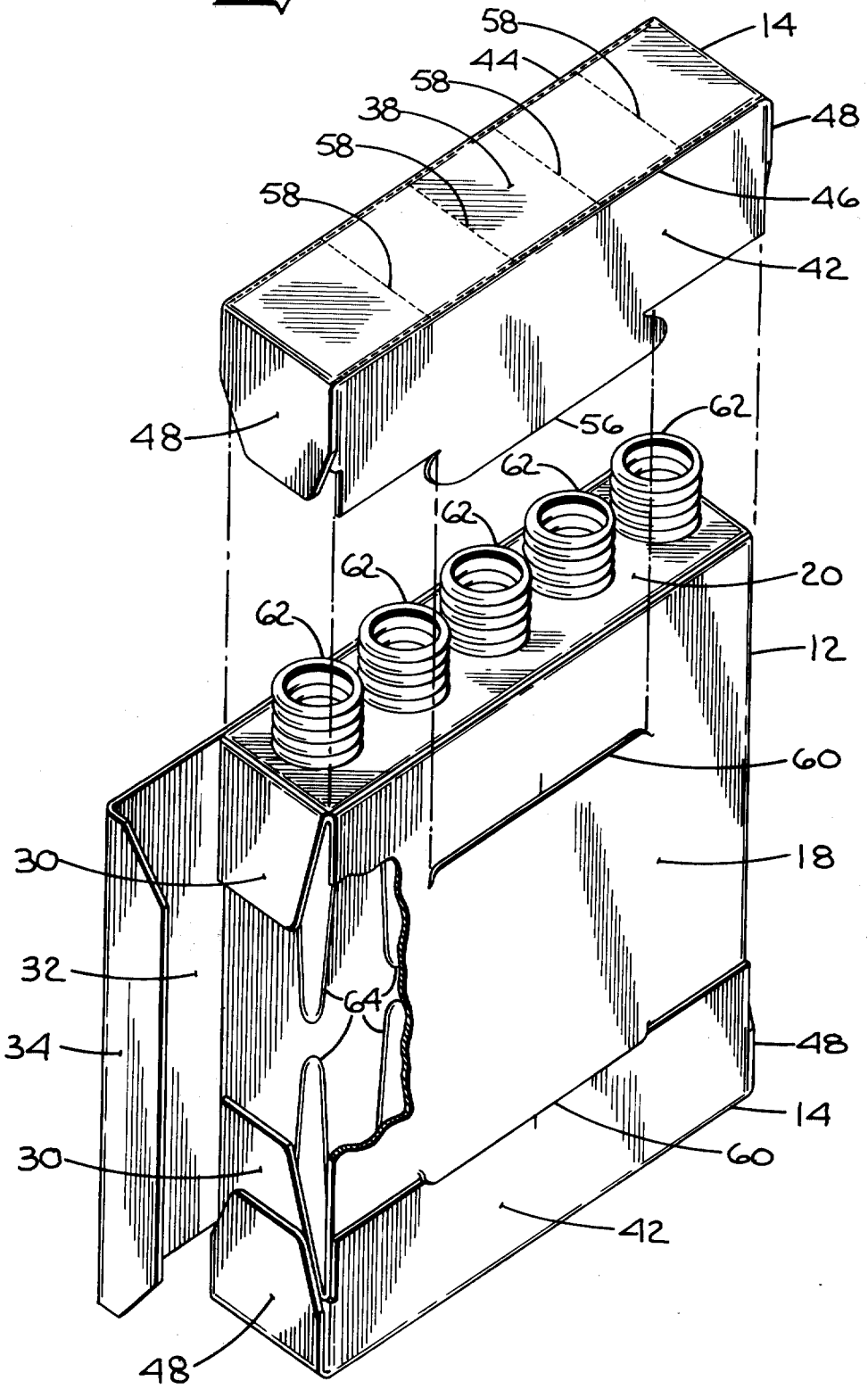
FIG. 5 is a fragmented perspective view of the cot dispenser of FIG. 1.

Referring to FIG. 5 there is shown carton 12 fully erected with one of the side closure assemblies opened and part of side wall 18 cut away. Stacks 62 of cots 64 are shown inserted into perforations 36 and suspended from the end panels. Each of the stacks 62 preferably include five cots 64 of the type having elongated tubular body portions with closed bottom ends and open top ends having beaded rims formed about the open ends. The cots are formed of latex in a manner well known in the art. The perforations in which the stacks are inserted have a diameter less than the outer diameter of the beaded cot rim so that the rim is fully supported by the end portion 20. The diameter of the perforations must be sufficiently large to receive the body portions of the stacked cots while allowing a probe to be inserted into the stack. The diameter of the perforations depends upon the number of cots one wishes to stack. The stacks are formed by telescopically inserting one cot inside another.

As previously mentioned it is preferred that each stack include five cots and that five stacks be inserted into each end panel so that the cot dispenser has a total capacity of 50 cots.

The cots may be inserted into the perforation by individually inserting each cot using a device similar to the thermometer probe or the cots may be inserted dusing automatic equipment designed for inserting a plurality of cots at one time. After the cots are inserted into the perforations, covers 14 are attached by inserting tabs 56 into slots 60 of erected carton 12. End flaps 48 of covers 14 are inserted between closure panel 32 and tabs 30 so as to completely cover and enclose the opened ends of the stacks 62 of cots. When the covers are in place and the closure assemblies are closed the cots are completely protected and may be maintained in a sanitary condition.

Figure 6:
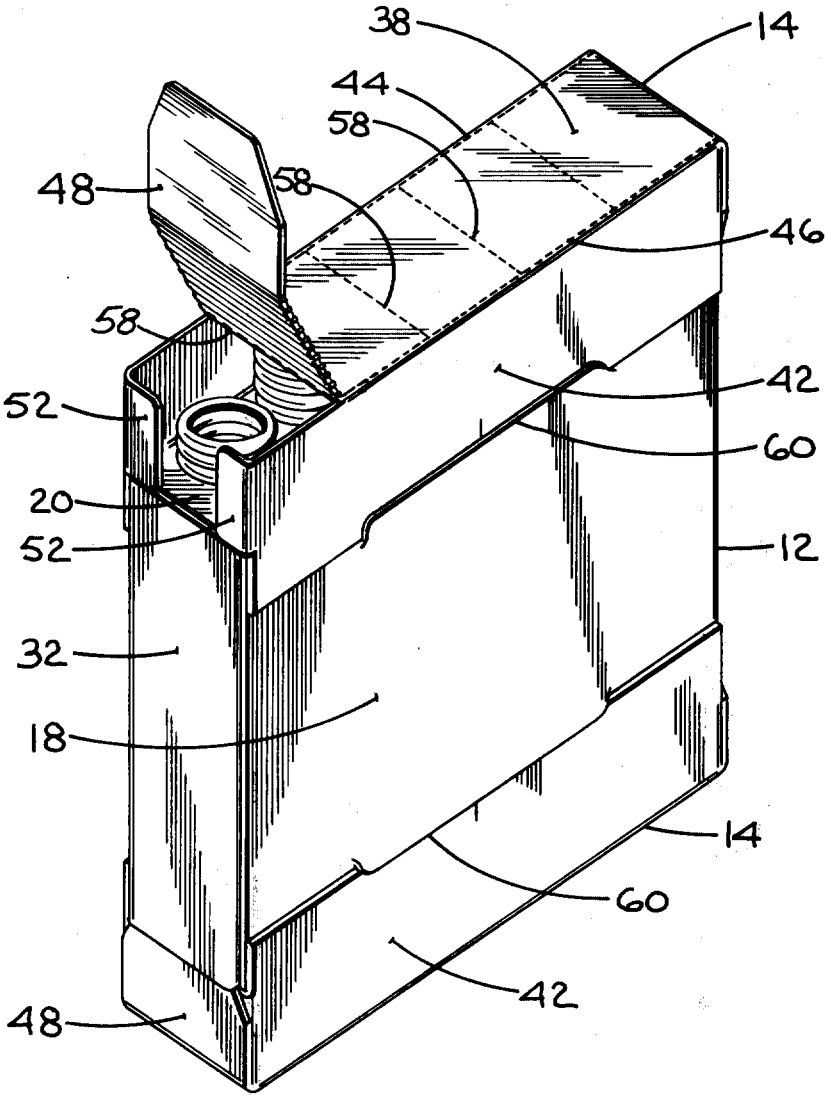
FIG. 6 shows the cot dispenser of FIG. 1 opened for removal of a cot.

Referring to FIG. 6 there is shown a cot dispenser that has been opened for removal of cots from the first stack 62 supported on end panel 20. The dispenser is opened by tearing the top portion 38 back along lines 44 and 46 to a point adjacent the first transverse perforation line 58 so that the top portion can be folded back along the transverse perforation line 58. The cots are removed by the use of an electronic-medical thermometer as described in U.S. Pat. No. 3,673,868. The thermometer probe is inserted into the upper most cot of the stack and the entire stack of cots is depressed or stretched while the uppermost cot is engaged by the cot retaining means of the thermometer. The inherent resiliency of the remaining cots urges the probe and the engaged cot in an upward direction to be discharged from the stack without disturbing the remaining cots. The uppermost cot is easily removed with the probe while the other cots remain freely suspended in the perforation. It is important to note that the cots must be stretched a sufficient distance so that the beaded rim of the cot may be engaged by the cot retaining means on the probe; therefore, the carton 12 must be of sufficient size so that the cot can be stretched the required distance.

The tear away cover provides for the serial exposure of cot stacks so that only one stack at a time is exposed to contamination. The exposure of one stack of cots is not critical since the portion of the cot that comes in contact with the patient is the outer surface of the cot body. Since the cot body is telescopically inserted into another cot or extends to the inside of carton 12 the outer surface is always protected until the cot is dispensed. The only portions of the cot that are exposed are the beaded rim and the inner surface of the cot body which do not come in contact with the patient.

After a number of cots have been used the dispenser may again be closed by inserting flap 48 in the slot formed between the side closure panel 32 and closure flap 30. This will prevent the remaining cots from being exposed to contamination. If desired, the user of the dispenser may remove a part of top portion 38 by tearing along one of the transverse perforation lines 58. However, it is suggested that the top portion remain intact so that the dispenser may be closed to prevent contamination of any remaining cots.

Thus, the present invention provides a unique and inexpensive cot dispensing system that facilitates removal of a single cot with ease not heretofore provided by the prior art. The portions of the cots that come in contact with the patient are always protected from contamination prior to use so as to remain in a sanitary condition. The dispenser is provided with a cover that may be closed to prevent contamination of cots remaining in the dispenser for subsequent use. The cots are telescopically inserted in each other to form stacks and then the stacked cots are inserted into a perforation formed in a cot support for removal with a medical probe. A unique and unexpected feature of the present invention is that the latex cots may easily be removed one at a time without disturbing the other cots that remain freely suspended from the cot support.

What is claimed is:

1. A package for storing and dispensing cots of the type used to cover medical probes, said cots having an elongated tubular body portion, a closed bottom end, an open top end and a beaded rim disposed about the open end, said probe having means, spaced from an end of said probe, for engaging the beaded rim of the cot when the cot is stretched over said probe, said package comprising:

a container having spaced perforations formed in at least a portion thereof each perforation having a diameter less than the outer diameter of the beaded cot rim and sufficiently large to receive the cot body portion and the probe so that the cots may be suspended in said perforations, said container being of sufficient size so that the probe may be inserted a sufficient distance into the cots to allow engagement of the beaded rim by the engagement means;

cover means for enclosing the perforations, said cover means being mounted to said container; and means associated with said cover means for exposing the perforations so that cots suspended in said perforations may be removed by inserting said probe and engaging the beaded rim with said engaging means.

2. A package as described in claim 1, wherein the means for exposing the perforations comprises a tear away portion of said cover.

3. A package as described in claim 1, wherein the perforations are formed in a straight line and the means for exposing the perforations comprises a tear away portion of said cover so that the perforations may be serially exposed.

4. A package as described in claim 3, wherein the tear away portion of the cover is defined by a pair of parallel perforated tear lines extending longitudinally along the cover so that the tear away portion overlays the perforations.

5. A package as described in claim 4, additionally comprising a plurality of transverse perforated tear lines formed between the parallel longitudinal tear lines and perpendicular thereto said transverse tear lines being positioned to define segments of said tear away portion so that said segments overlay said perforations and the segments may be removed to serially expose the perforations.

6. A package as described in claim 1, wherein said container comprises a box having perforations formed in a pair of opposing sides and a pair of cover means for enclosing said perforations.

7. A package as described in claim 1, wherein the cover means is detachably mounted to the container.

8. A package as described in claim 1, wherein the container is a folded cardboard carton.

9. A package as described in claim 1, wherein the cover means is formed of folded cardboard.

10. A device for dispensing and mounting cots onto medical probes of the type having means, spaced from an end of the probe, for engaging a cot and holding it in place on the probe, said device comprising:

a plurality of cots of the type used to cover medical probes, said cots having an elongated tubular body portion, a closed bottom end, an open top end and a beaded rim disposed about the open top end, said cots being telescopically inserted into each other to form stacks having a predetermined number of cots;

a container having spaced perforations formed in at least a portion thereof, each of said perforations having a diameter less than the outer diameter of the beaded cot rims but sufficiently large to receive the cot stacks and a medical probe, said cot stacks being suspended in the perforations and the container being of sufficient size so that the medical probe may be inserted a sufficient distance into the cot stacks so that the engaging means of the probe may engage the beaded rim of the upper most cot;

cover means for enclosing the cot stacks suspended in the perforations, said cover means being mounted to said container; and means associated with said cover means for exposing the cot stacks, so that cots may be removed by inserting the medical probe and engaging the beaded rim with said engaging means.

11. A device as described in claim 10, wherein the means associated with said cover means for exposing the cot stacks comprises a means for serially exposing one cot stack at a time.

12. A package as described in claim 1, additionally comprising means associated with said cover means for recovering exposed perforations.

13. A device as described in claim 10, wherein the container and cover means are formed of folded cardboard.

* * * * *